US009167874B2

(12) United States Patent
Shlafer

(10) Patent No.: US 9,167,874 B2
(45) Date of Patent: Oct. 27, 2015

(54) MAT AND A SYSTEM AND METHOD FOR CONVERTING THE MAT TO A BAG

(71) Applicant: Jonathan Shlafer, Maplewood, NJ (US)

(72) Inventor: Jonathan Shlafer, Maplewood, NJ (US)

( * ) Notice: Subject to any disclaimer, the term of this patent is extended or adjusted under 35 U.S.C. 154(b) by 153 days.

(21) Appl. No.: 13/791,268

(22) Filed: Mar. 8, 2013

(65) Prior Publication Data

US 2014/0252052 A1 Sep. 11, 2014

(51) Int. Cl.

| | |
|---|---|
| ***A45C 9/00*** | (2006.01) |
| ***A47G 9/06*** | (2006.01) |
| *A45F 4/06* | (2006.01) |
| *A45C 13/10* | (2006.01) |
| *A45C 7/00* | (2006.01) |

(52) U.S. Cl.
CPC . *A45C 9/00* (2013.01); *A47G 9/062* (2013.01); *A45C 13/1046* (2013.01); *A45C 2007/0013* (2013.01); *A45F 4/06* (2013.01)

(58) Field of Classification Search
CPC .... A45C 2007/0004; A45C 9/00; A45C 3/10; A45F 4/02; A45F 3/04
USPC ..... 224/578, 581, 582, 577, 153; 383/4, 383/72–76
See application file for complete search history.

(56) References Cited

U.S. PATENT DOCUMENTS

| | | | | | |
|---|---|---|---|---|---|
| 4,738,545 | A * | 4/1988 | Westgor | 383/4 |
| 4,991,978 | A * | 2/1991 | Ostrowski | 383/4 |
| 5,092,681 | A * | 3/1992 | Ashley, III | 383/4 |
| 5,187,823 | A * | 2/1993 | Ferguson et al. | 5/417 |
| 5,195,828 | A * | 3/1993 | Bush-Rodriquez | 383/4 |
| 5,207,508 | A * | 5/1993 | Koutsis, Jr. | 383/4 |
| 5,819,343 | A * | 10/1998 | Zampirri et al. | 5/417 |
| 5,895,118 | A * | 4/1999 | Hensley | 383/3 |
| 6,176,356 | B1 * | 1/2001 | Powley | 190/1 |

* cited by examiner

*Primary Examiner* — Brian D Nash
*Assistant Examiner* — Corey Skurdal
(74) *Attorney, Agent, or Firm* — Patents+TMS, P.C.

(57) ABSTRACT

A system and method converts a mat between a first position and a second position. A perimeter of the mat may be weighted to maintain the mat in the first position wherein the mat is substantially flat in the first position. A rope may be provided that extends around the perimeter of the mat. The rope may be pulled to move the mat into the second position wherein the mat forms a bag in the second position. A locking mechanism may slide in a first direction on the rope to secure an opening formed by the mat in the second position.

11 Claims, 2 Drawing Sheets

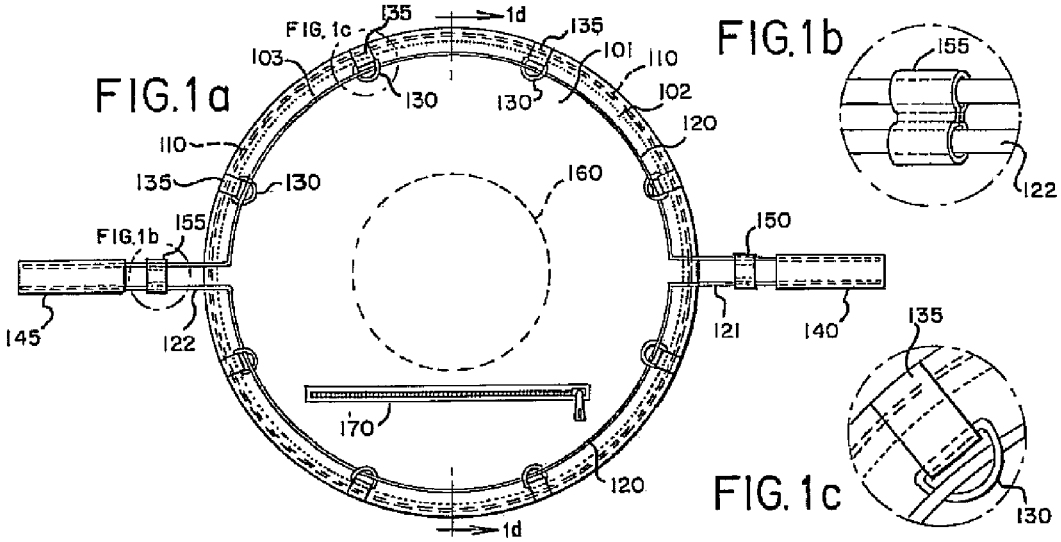
FIG.1a
FIG.1b
FIG.1c
FIG.1d
FIG.1c
135
1d
135
101
110
103
130
130
102
120
110
135
130
160
155
FIG.1b
150
145
122
121
140
170
120
1d
155
122
135
130
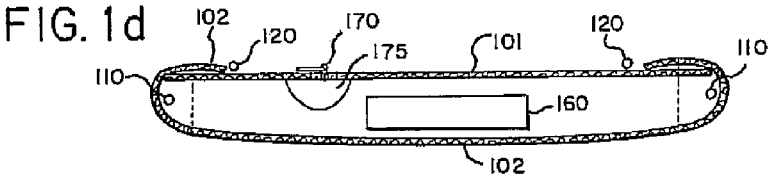
FIG. 1d
102
120
170
175
101
120
110
110
160
102

MAT AND A SYSTEM AND METHOD FOR CONVERTING THE MAT TO A BAG

BACKGROUND OF THE INVENTION

The present invention generally relates to a mat and a system and a method for converting a mat into a carrying bag. More specifically, the present invention relates to a mat which may be used as a changing station or a picnic station, and after use may be converted into a carrying bag.

Activities that involve water and/or sand such as swimming or surfing, for example, often require a participant to change clothes while participating in the activity or after finishing the activity. For example, a swimmer, snorkeler, deep water diver or a surfer in an ocean or other body of water often wears a wetsuit. The wetsuit is appropriate for the activity; however the participant generally desires to remove the wetsuit and/or other apparel or accessories worn during the activity. Upon exiting the body of water, sand is often encountered, and removal of the apparel and/or accessories without collecting too much sand on the apparel and/or accessories is often difficult. The participant changes from the wet clothes on the beach and often uses a towel to dry off. The participant currently places both the towel and the wet clothes on the sand. Consequently, sand accumulates on the towel and/or the wet clothes. The participant may use a bag to place their clothes after completing their activity. The bag also collects sand from the wet clothes and/or the towel. A need, therefore, exists for a mat that may be used in an area, such as a beach. More specifically, a need exists for a mat that may be used as a changing station and may be converted into a carrying bag to carry items. A need also exists for a mat that may be converted into a carrying bag.

SUMMARY OF THE INVENTION

The present invention generally relates to a mat and a system and a method for converting a mat into a carrying bag. More specifically, the present invention relates to a mat which may be waterproof and which may be used as a changing station and a picnic blanket, and also may be converted into a carrying bag. The mat may have a back layer which may be made of a waterproof fabric. The back layer of the mat may be secured to the front layer. A disk may be configured between the front layer and the back layer of the mat. The mat may have two ropes that may be configured on an exterior portion of the mat. A first rope may provide weight for the mat to act as a changing station or a picnic blanket.

A second rope may have a handle attached to both ends of the second rope to be used to convert the mat from a changing station or picnic blanket into a bag. A locking mechanism or slider may be configured on each end of the second rope. Spaced tabs with rings may also be placed on the of the mat. The first rope may be secured through the spaced tabs while the second rope may be threaded through the rings.

To this end, in an embodiment of the present invention, method converts a mat between a first position and a second position. The method has the steps of weighting a perimeter of the mat to maintain the mat in the first position wherein the mat is substantially flat in the first position; providing a rope extending around the perimeter of the mat; pulling the rope to move the mat into the second position wherein the mat forms a bag in the second position; and sliding a locking mechanism in a first direction on the rope to secure an opening formed by the mat in the second position.

In an embodiment, the method has the step of attaching a handle on the rope.

In an embodiment, the method has the step of providing a tab on the perimeter of the mat to allow the rope to extend around the perimeter of the mat.

In an embodiment, the method has the step of sliding the locking mechanism in a second direction on the rope to secure the mat in the first position wherein the second direction is opposite to the first direction.

In an embodiment, the method has the step of providing a ring on the perimeter of the mat.

In an embodiment, the method has the step of providing a disk on the mat wherein the disk is foam.

In an embodiment, the method has the step of providing a pocket on the mat wherein the pocket is accessible by a fastener in the mat.

In another embodiment of the present invention, a mat is provided having a front layer and a back layer formed substantially coplanar wherein the back layer is larger than the front layer wherein an edge of the back layer is folded to secure the edge to the front layer and forms a channel along the edge. A first rope is in the channel. A second rope is on the front layer wherein the second rope moves between a first position and a second position and forms a bag in the second position.

In an embodiment, the mat has a tab on the front layer wherein the second rope is threaded through the tab.

In an embodiment, the mat has a pocket between the front layer and the back layer wherein the pocket forms a compartment accessible from the front layer.

In an embodiment, the mat has a fastener on the front layer to provide access to a compartment between the front layer and the back layer.

In an embodiment, the mat has a slider on the second rope wherein the slider moves on the second rope between the first position and the second position.

In an embodiment, the mat has a disk between the front layer and the back layer.

In another embodiment of the present invention, a system converts a mat to a bag. A planar disk is formed from a front layer and a back layer. A rope is secured to the front layer. A handle is attached to the rope to pull the rope in a substantially vertical direction. A slider is on the rope wherein the slider moves along the rope in the vertical direction and locks in a position to maintain the disk in a closed position forming the bag.

In an embodiment, the system has a tab to connect the rope to the front layer of the mat.

In an embodiment, the system has a fastener on the front layer and a compartment between the front layer and the back layer that is accessible through the fastener.

In an embodiment, the system has a ring on a perimeter of the front layer wherein the rope is threaded through the ring.

It is, therefore, an advantage of the present invention to provide a mat, a system and a method to provide a mat that converts to a bag.

Another advantage of the present invention is to provide a mat, a system and a method that may be used on a variety of surfaces, such as a changing station on a beach or as a picnic station in a park, for example.

Another advantage of the present invention is to provide a mat, a system and a method that prevents unwanted material, such as sand, to accumulate on the mat.

A still further advantage of the present invention is to provide a mat, a system and a method that converts to a bag and secured in an efficient manner.

Another advantage of the present invention is to provide a mat, a system and a method that converts to a changing station from a bag in an efficient manner.

A further advantage of the present invention is to provide a mat, a system and a method that is waterproof.

Another advantage of the present invention is to provide a mat, a system and a method that provides a disk within a front layer and a back layer of the mat with which to dispose of items such as wet clothes.

A still further advantage of the present invention is to provide a mat, a system and a method that provides a locking mechanism to secure the mat as a bag.

Another advantage of the present invention is to provide a mat, a system and a method that provides a weight for the mat to be used as a changing station.

Additional features and advantages of the present invention are described in, and will be apparent from, the detailed description of the presently preferred embodiments and from the drawings.

BRIEF DESCRIPTION OF THE DRAWINGS

FIG. 1(*a*) illustrates a top view of an embodiment of a system in a first position.

FIG. 1(*b*) illustrates a top view of an embodiment of the system in the first position.

FIG. 1(*c*) illustrates a top view of an embodiment of the system in the first position.

FIG. 1(*d*) illustrates a cross-sectional view taken generally along the line D-D of FIG. 1(*a*).

FIG. 2(*b*) illustrates a perspective view of the system as the system is lifted in an embodiment of the system of the present invention.

FIG. 2(*c*) illustrates a perspective view of the system as the system is pulled in an embodiment of the system of the present invention.

FIG. 2(*d*) illustrates a perspective view of the system as the system is secured in an embodiment of the system of the present invention.

DETAILED DESCRIPTION OF THE PRESENTLY PREFERRED EMBODIMENTS

Figure 2A:
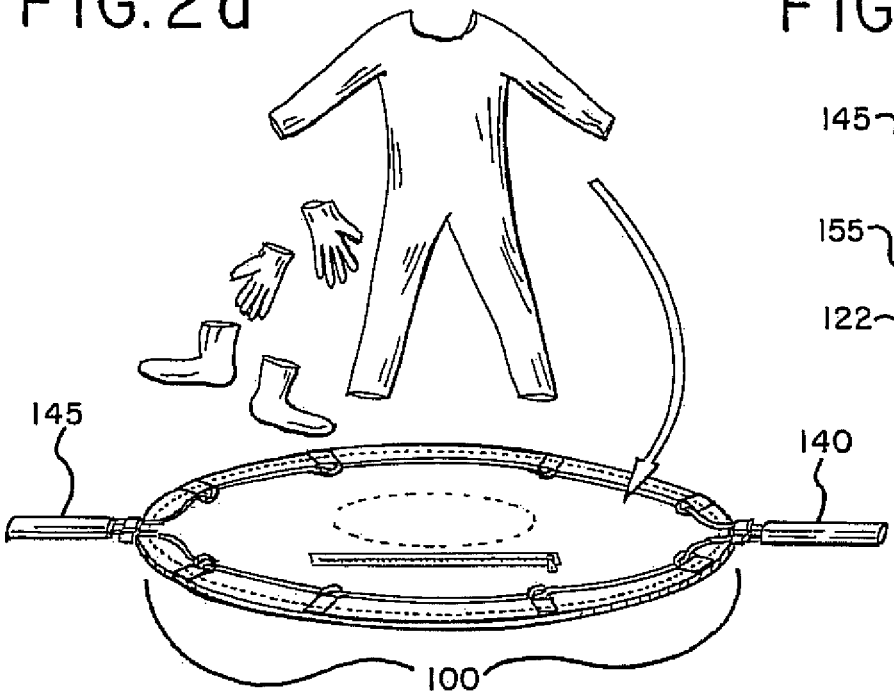
FIG. 2(*a*) illustrates a perspective view of items loaded onto a mat in an embodiment of the system of the present invention.

The present invention generally relates to a mat and a system and method for converting the mat from a first position to a second position. More specifically, the present invention relates to a system which may be converted from a changing station into a bag. The mat of the system may be used, for example, as a changing station or as a picnic blanket. The mat may have a waterproof back layer. The waterproof back layer may allow materials after converting to the bag to remain dry. A padded disk made from foam may be placed between a front layer of the mat and the back layer of the mat. The mat may also have a first rope that may be secured to the exterior of the mat that may provide a weight to allow the mat to stay in the first position. In addition, the mat have a second rope on the exterior of the mat with handles that may be connected to the second rope. The handles may be used to convert the system from the first position to the second position.

In the following description, numerous details are set forth to provide an understanding of the present invention. However, it will be understood by one of ordinary skill in the art that the present invention may be practiced without these details and that numerous variations or modifications from the described embodiments may be possible.

Referring now to the drawings, FIG. 1(*a*) illustrates a diagram of a top view of a system 1 in a first position. The first position is generally illustrated and defined by the system 1 in a flat or planar orientation position illustrated by FIG. 1(*a*). A second position is generally illustrated and defined by the system in a closed bag-like shape. The surface may be sand that may be located on a beach, but is not limited to sand. A user of the system 1 may leave a body of water wearing, for example, a wetsuit during an activity, such as surfing, swimming, snorkeling or diving. After leaving the water, the system 1 may be placed on the surface so that the user may remove the wetsuit and/or other clothing or accessories and may change, if desired, into dry clothing.

The sliders 150, 155 may be constructed from two tubes which may be made from plastic, which may be attached to each other, for example, by a fabric webbing as illustrated in FIG. 1(*b*). The material that may be used to attach the two tubes is not be limited to fabric, and the sliders 150, 155 may, for example, be formed as a single piece from a single material, such as plastic. The slider 155 in FIG. 1(*b*) illustrates two attached tubes that may be attached together by the fabric webbing to form the slider 155 shown in FIG. 1(*b*).

The system 1 may be placed in the first position by pulling the sliders 150, 155 toward the handles 140, 145 on the system 1. The system 1 may be held in the first position by a first rope 110 that may be secured onto an exterior portion 103 of the mat 100 to provide a weight that may allow the system 1 to stay in the first position.

The mat 100 may have a front layer 101 and a back layer 102. The front layer 101 may be placed above the back layer 102, as shown in FIGS. 1(*a*), 1(*c*) and 1(*d*). The front layer 101 may be a lighter fabric than the back layer 102. In a preferred embodiment, the back layer 102 has a circumference of 135 inches. The present invention is not limited to the size, however. In addition, the back layer 102 may be made from a heavyweight waterproof fabric. The periphery of the back layer 102 may be folded over the first rope 110 and then may be secured to the front layer 101 or otherwise attached. In a preferred embodiment, the back layer 102 is sewn to the front layer 101.

Figure 2D:
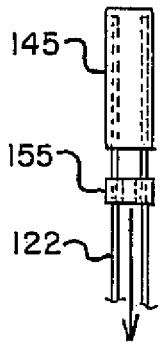
Figure 2B:
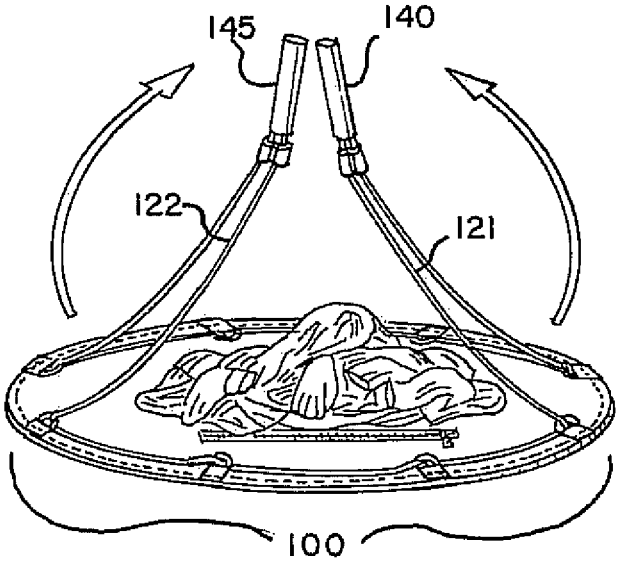
Figure 2C:
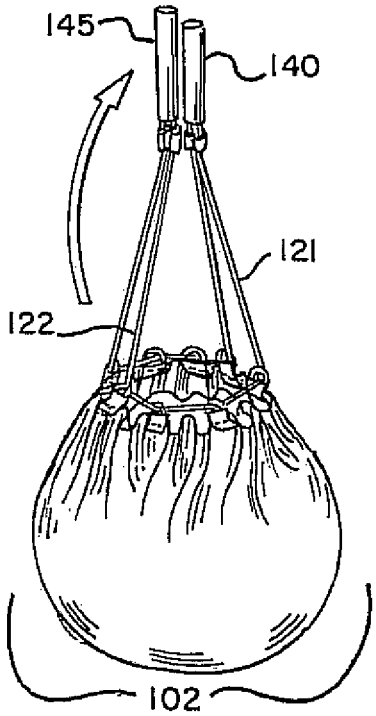

A second rope 120 may be threaded through the sliders 150, 155 and the handles 140, 145. The sliders 150, 155 may move along the length of the second rope 120. The sliders 150, 155 may be moved to and from the locking position, as shown in FIG. 2(*d*). The second rope 120 may be secured to the exterior portion 103 of the mat 100. The second rope 120 may have a first end 121 and a second end 122. The handle 140 may be secured at the first end 121 by threading the handle 140 through the first end 121 of the second rope 120. The handle 145 may be secured at the second end 122 by threading the handle 145 through the second end 122 of the second rope 120. The sliders 150, 155 may move to and from the handles 140, 145 and towards the locking position shown in FIG. 2(*d*). The handles 140, 145 and the sliders 150, 155 may allow the user to convert the system 1 to/from a carrying bag and/or a changing station. When the user pulls the handles 140, 145 in the vertical direction shown in FIG. 2(*b*), the system 1 may be converted to a carrying bag. When the user pulls the handles 140, 145 in the downward vertical direction, the system 1 may be converted to a changing station.

The slider 150 may be positioned on the first end 121 of the second rope 120; the slider 155 may be positioned on the second end 122 of the second rope 120. If the system 1 is being used as a changing station, the sliders 150, 155 may be positioned near the handles 140, 145. If the system is being used as a carrying bag, the sliders 150, 155 may be positioned in the locking position illustrated by FIG. 2(*d*).

To convert the system 1 from a carrying bag to a changing station, the sliders 150, 155 may be moved from the locking position toward the handles 140, 145 on the second rope 120. The handles 140, 145 may be pulled down vertically, which may place the system 1 in the first position, for example, laying flat on the sand. The sliders 150, 155 may be abutted against the handles 140, 145 to maintain the system 1 in the first position. The first rope 110 may provide weight necessary to maintain the system 1 in the first position.

Referring to FIGS. 1(*a*) and 1(*c*), the second rope 120 on the mat 100 may be connected to the first rope 110 by rings 130, for example D-rings. The rings 130 may be constructed from, for example, plastic or metal. The exterior portion 103 of the mat 100 may be secured with the tabs 135 as shown in FIGS. 1(*a*) and 1(*c*). In a preferred embodiment, the rings 130 may be threaded through the tabs 135 to secure the rings 130 to the tabs 135. In addition, the second rope 120 may be threaded through the rings 130. FIG. 1(*d*) shows a cross-sectional view of the system 1. The user of the system 1 may step onto the mat 100 when the system 1 is generally flat in the first position. The user may dry off with a towel, for example, and may remove clothing and place the clothing onto the mat 100. A disk 160 may be provided in the mat 100 at or near the center of the mat 100. The disk 160 may be secured by a means known to one of ordinary skill in the art. Further, in a preferred embodiment, the disk 160 may be made from, for example, foam, and may be placed or otherwise secured between the front layer 101 and the back layer 102 of the mat 100 as shown in FIG. 1(*d*). The user may step onto the disk 160 to change from wet clothes.

The use of the system 1 may not be limited to use as a changing station. The system 1 may also be used as a picnic station or a picnic blanket. The user may have a meal or read a book or magazine with the system 1. At a park, the system 1 may be placed in the first position as described above. The system 1 may be used as a waterproof picnic station. To this end, the user may sit down and may place the materials in his or her possession on the mat 100. The back layer 102 of the mat 100 may be made of waterproof fabric material. As a result, the mat 100 may provide a waterproof area which the user may use to perform picnic related activities such as reading, eating, and the like. A fastener 170 may also be positioned near the disk 160. The fastener 170 may be situated on the front layer 101 of the mat 100 may provide access to a compartment 175 between the front layer 101 and the back layer 102.

FIG. 2(*a*) shows the system 1 as clothes may be placed on the mat 100 by the user. The user may step on the disk 160 at or near the center of the mat 100 and may change from, for example, a wetsuit or other clothing or accessories without having to place the clothing on the surface surrounding the mat 100.

FIG. 2(*b*) shows the system with the handles 140, 145 lifted in a substantially vertical direction after items items have been placed on the mat 100. The second rope 120 may be threaded through the handles 140, 145 at the ends 121, 122 of the second rope 120. Accordingly, lifting the handles 140, 145 in the substantially vertical direction may allow the second rope 120 to pull the mat 100 from the first position to the second position. When the handles 140, 145 are lifted vertically, the second rope 120 may be configured at an angle.

FIG. 2(*c*) illustrates the handles 140, 145 on the second rope 120 pulled substantially vertically to move the system 1 toward the second position. After the handles 140, 145 are pulled in the vertical direction, the sliders 150, 155 may be positioned near the handles 140, 145, respectively. The sliders 150, 155 may be slid in a direction away from the handles 140, 145 into the locking position. The system 1 may be secured as a carrying bag when the sliders 150, 155 are slid into the locking position.

FIG. 2(*d*) illustrates the sliders 150, 155 in the locking position. The sliders 150, 155 of the second rope 120 may be placed near the handles 140, 145 of the second rope 120 when the system 1 is configured in the first position. The sliders 150, 155 may be near the handles 140, 145 and may be slid from the handles 140, 145 to the locking position. After the sliders 150, 155 of the second rope 120 are positioned in the locking position, the system 1 may be secured in the second position. After the sliders 150, 155 have been secured in the locking position, the second rope 120 may be positioned at an angle. A tension and/or a friction that may be created by the angle of the second rope 120 may assist the sliders 150, 155 to stay in the locking position. After the sliders 150, 155 are moved in the locking position, the system 1 may form a carrying bag.

To place the system 1 in the first position, the procedure described with respect to FIG. 1(*a*) may be repeated. The sliders 150, 155 may be moved from the locking position toward each of the handles 140, 145 on the second rope 120. The handles 140, 145 on the second rope 120 may then be pulled to place the system 1 in the first position. The first rope 110 on the exterior of the mat 100 may provide the weight necessary to assist the system 1 to convert from the second position to the first position.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

I claim:

1. A method for converting a mat into a bag wherein the mat has a perimeter wherein a plurality of rings are attached at the perimeter wherein the mat has a top layer and a bottom layer that are formed substantially coplanar wherein the top layer is substantially circular having a first diameter and the bottom layer is substantially circular having a second diameter wherein the second diameter is larger than the first diameter wherein the bottm layer is folded to secure the top layer to the bottom layer and forms a channel wherein a first rope is located in the channel and further wherein a second rope is threaded through the plurality of rings to secure the second rope to the mat wherein the second rope has ends that attach inside a first handle and a second handle, the method comprising the steps of:

placing an article on the mat; and pulling the first handle and the second handle in a vertical direction with respect to the top layer to gather the plurality of rings to form the bag.

2. The method of claim 1 further comprising the step of:

attaching a plurality of tabs on the perimeter of the mat to allow the second rope to extend around the perimeter of the mat.

3. The method of claim 1 further comprising the step of:

sliding the locking mechanism on the second rope in a direction away from the first handle and the second handle to secure an opening formed by the bag.

4. The method of claim 1 further comprising the step of:

inserting a disk between the top layer and the bottom layer of the mat wherein the disk is foam.

5. The method of claim 1 further comprising the step of:

providing a pocket on the mat wherein the pocket is accessible by a fastener in the mat.

6. A mat having an exterior defined by an outer edge and having a first section and a second section that divide an area within the exterior, the mat comprising:

a front layer and a back layer formed substantially coplanar wherein the front layer is substantially circular having a first diameter wherein the back layer is substatially circular having a second diameter wherein the diameter of the back layer is larger than the diameter of the front layer and further wherein the back layer is folded to secure the back layer to the front layer and forms a channel;

a first rope in the channel;

a first plurality of rings secured to the first section;

a second plurality of rings secured to the second section;

a second rope having a first part and a second part wherein the first part and the second part have a length defined between a first end and a second end wherein the first end is positioned opposite to the second end wherein the first part is threaded through the first plurality of rings and further wherein the second part is threaded through the second plurality of rings;

a first handle wherein the first end of the second rope extends into the first handle; and a second handle wherein the second end of the second rope extends into the second handle.

7. The mat of claim 6 further comprising:

a first plurality of tabs individually connected to a corresponding one of the first plurality of rings and a second plurality of tabs individually connected to a corresponding one of the second plurality of rings.

8. The mat of claim 6 further comprising:

a pocket between the front layer and the back layer wherein the pocket forms a compartment accessible from the front layer.

9. The mat of claim 6 further comprising:

a fastener on the front layer to provide access to a compartment between the front layer and the back layer.

10. The mat of claim 6 further comprising:

a first slider on the first end of the second rope and a second slider on the second end of the second rope wherein the first slider moves on the second rope from the first handle to one of the first plurality of rings and one of the second plurality of rings and further wherein the second slider moves on the second rope from the second handle to one of the first plurality of rings and one of the second plurality of rings.

11. The mat of claim 6 further comprising:

a disk between the front layer and the back layer.

* * * * *